US006386912B1

(12) United States Patent
Li

(10) Patent No.: US 6,386,912 B1
(45) Date of Patent: May 14, 2002

(54) CABLE CONNECTOR

(75) Inventor: Jackie Li, Taichung Hsien (TW)

(73) Assignee: Pou Kaing International Co., Ltd., Taichung-Hsien (TW)

( * ) Notice: Subject to any disclaimer, the term of this patent is extended or adjusted under 35 U.S.C. 154(b) by 0 days.

(21) Appl. No.: 09/850,150

(22) Filed: May 8, 2001

(51) Int. Cl.[7] ..... H01R 9/05
(52) U.S. Cl. ..... 439/578
(58) Field of Search ..... 439/578–585, 439/610, 470, 98, 449; 174/135; 2/460

(56) References Cited

U.S. PATENT DOCUMENTS 5,362,251 A * 11/1994 Bielak ..... 439/394
5,667,409 A * 9/1997 Wong et al. ..... 439/654
5,865,654 A * 2/1999 Shimrak et al. ..... 439/852
5,954,542 A * 9/1999 Wu et al. ..... 439/610
6,042,421 A * 3/2000 Gray et al. ..... 439/578
6,203,372 B1 * 3/2001 Matsumoto et al. ..... 439/607
6,231,387 B1 * 5/2001 Kameyama ..... 439/578
6,270,377 B1 * 8/2001 Miyazaki et al. ..... 439/610

* cited by examiner

*Primary Examiner*—P. Austin Bradley
*Assistant Examiner*—Ross Gushi
(74) *Attorney, Agent, or Firm*—Browdy and Neimark

(57) ABSTRACT

A cable connector comprising a hollow cylindrical main body of a metal conductive to electricity. The main body has an open end for inserting a cable end. The open end is provided with two extension arms, with each folding in reverse into the main body. The folded segments are provided with a projected section. The two projected sections form therebetween a clamping area. The main body is provided in the wall with two slits corresponding in location to the ends of the two extension arms. The main body is further provided with two pliable movable plate portions, with each being located in an area that is enclosed by the shape of the slit.

4 Claims, 6 Drawing Sheets

CABLE CONNECTOR

FIELD OF THE INVENTION

The present invention relates generally to a cable, and more particularly to a cable connector.

BACKGROUND OF THE INVENTION

As shown in FIGS. 1–3, a prior art cable connector is made of a copper material and is provided with a plastic connector 10, as shown in FIG. 1. The size of the inner diameter or the outer diameter of the connector is not allowed to have a great error. As shown in FIGS. 2 and 3, the prior art cable connector has a conductive main body 11 which is provided in two sides with a plate clamping portion 12 of a recessed construction. Located between the two plate clamping portions is a clamping area 13 for clamping a cable 14 which is inserted into the conductive main body 11. The clamping strength provided by the two clamping portions 12 is insufficient.

As shown in FIG. 4, another prior art cable connector is different from the precedent prior art cable connector in design in that the former has a conductive main body 20 which is provided at the opening end with two extension arms 21 extending into the conductive main body in such a manner that the curved segment is provided with a protruded section 22 extending toward the axial center of the conductive main body, thereby resulting in formation of a clamping area 23 located between the two protruded sections for clamping the cable which is inserted thereinto. In light of the outer diameter of the product being fixed, the cable can not be easily inserted. If the cable is forced into the main body, the protruded sections 22 are susceptible to permanent deformation, thereby resulting in loss of clamping capability of the two protruded sections in relation to the clamping area 23.

As shown in FIG. 5, the first prior art cable connector is improved in such a fashion that the outer diameter of the conductive main body 30 is provided with two slits 31 parallel to the axial direction of the conductive main body so as to enable the outer diameter to expand at the time when the cable is inserted, thereby minimizing the likelihood of deformation of the two protruded sections 22. However, when the cable is inserted, the outer diameter of the conductive main body 30 is considerably enlarged to the extent that the conductive main body can no longer be fitted into the plastic connector. The plastic connector must be enlarged at an extra cost.

SUMMARY OF THE INVENTION

The primary objective of the present invention is to provide a cable connector which is free of the drawbacks of the prior art cable connectors described above.

The cable connector of the present invention comprises a hollow conductive main body of a cylindrical construction and having an open end via which a cable end is put through to be connected to the connector. The open end is provided with at least two extension arms extending therefrom such that the extension arms are folded in reverse into the conductive main body. The segment that is folded is provided with a protruded section extending toward the axial center of the conductive main body, thereby resulting in formation of a clamping area located between the two protruded sections. The conductive main body is provided with two slits penetrating the wall of the conductive main body and corresponding in location to the ends of the two extension arms. The conductive main body is provided with two pliable and movable plate portions which are respectively enclosed by the shapes of the two slits.

DETAILED DESCRIPTION OF THE INVENTION

Figure 1:
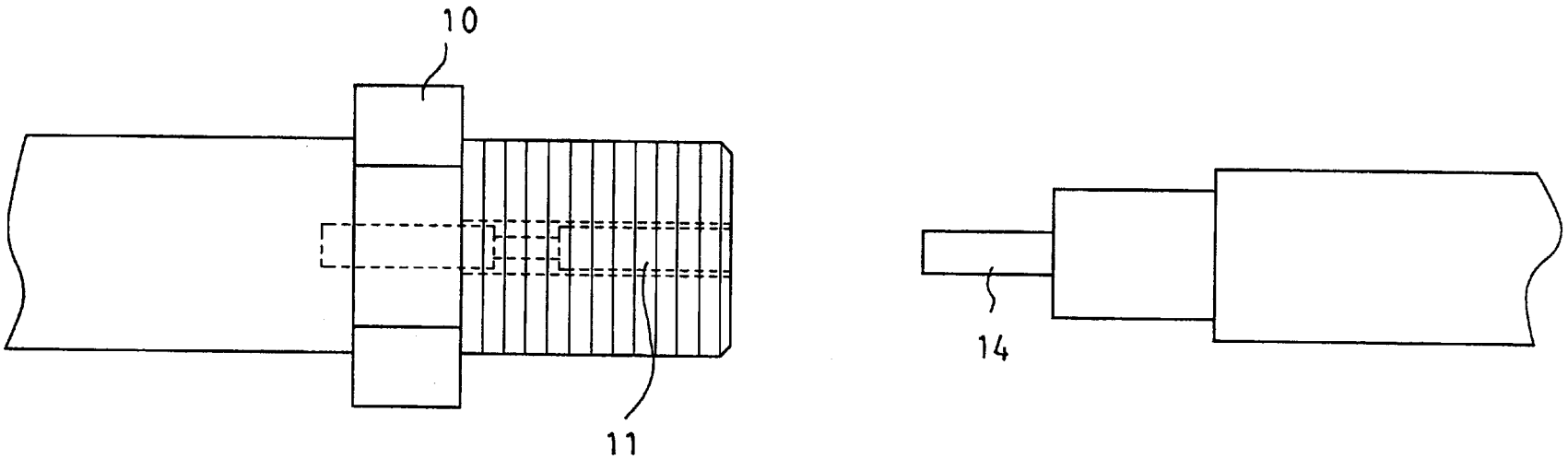
FIG. 1 PRIOR ART
FIGS. 1–3 show a first prior art cable connector.
Figure 2:
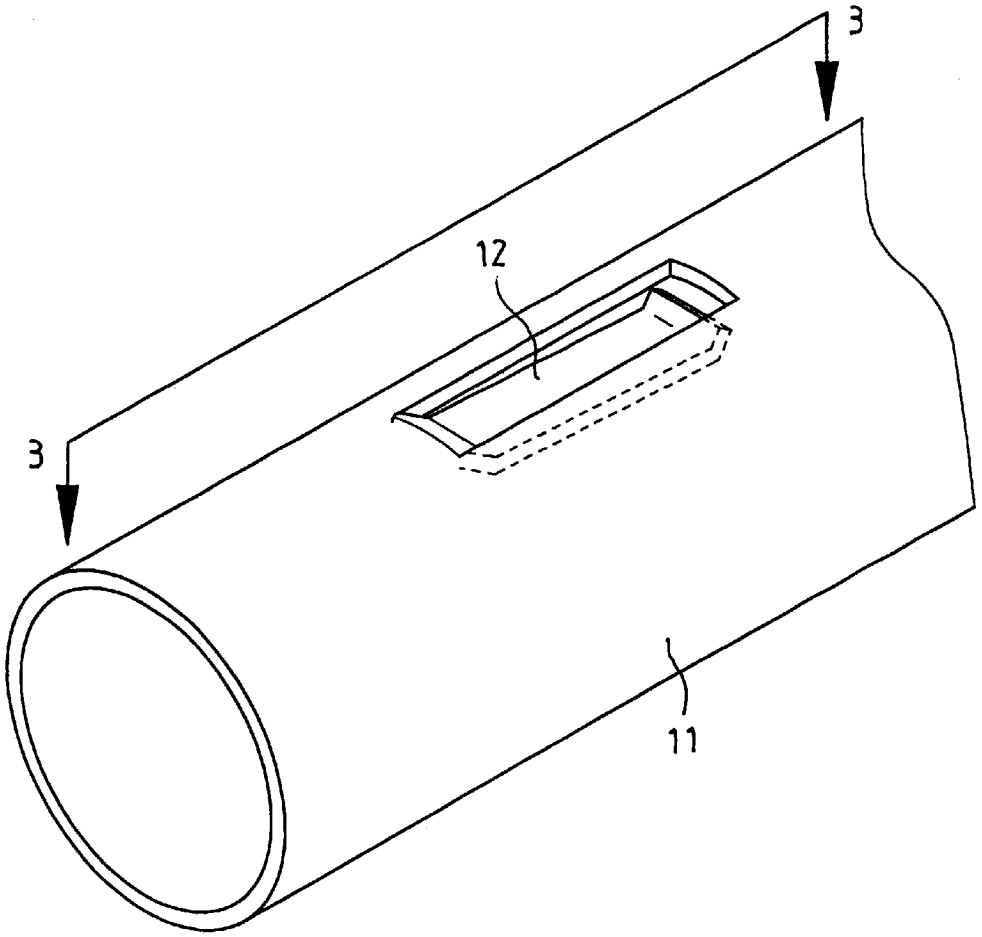
FIG. 2 PRIOR ART
Figure 3:
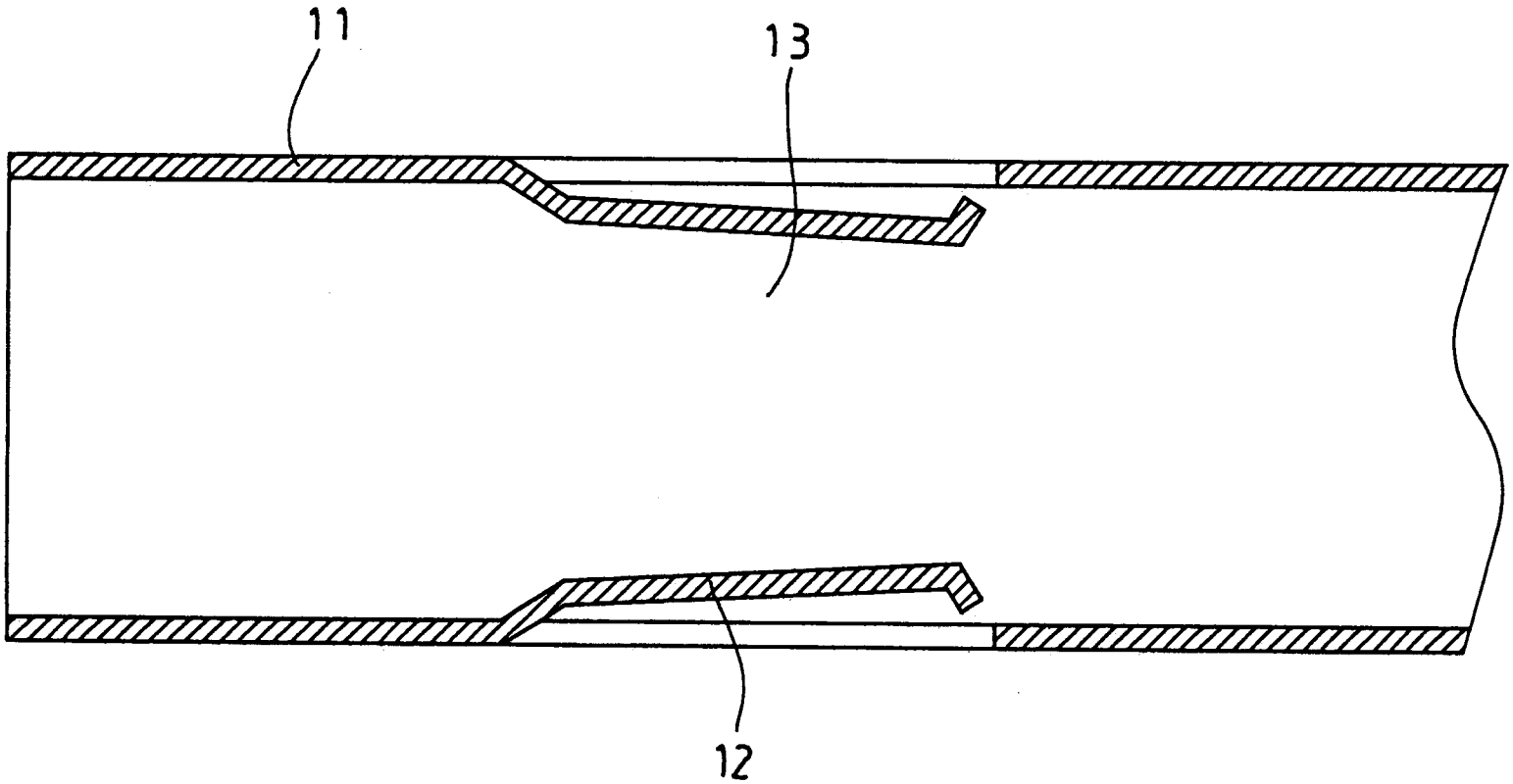
FIG. 3 PRIOR ART
Figure 5:
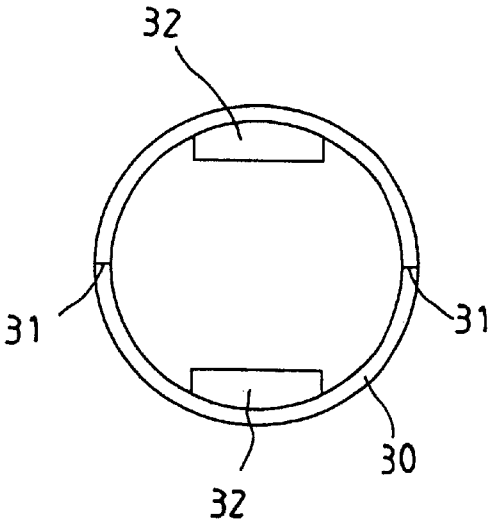
FIG. 5 PRIOR ART
FIG. 5 shows an improved version of the first prior art cable connector.
Figure 4:
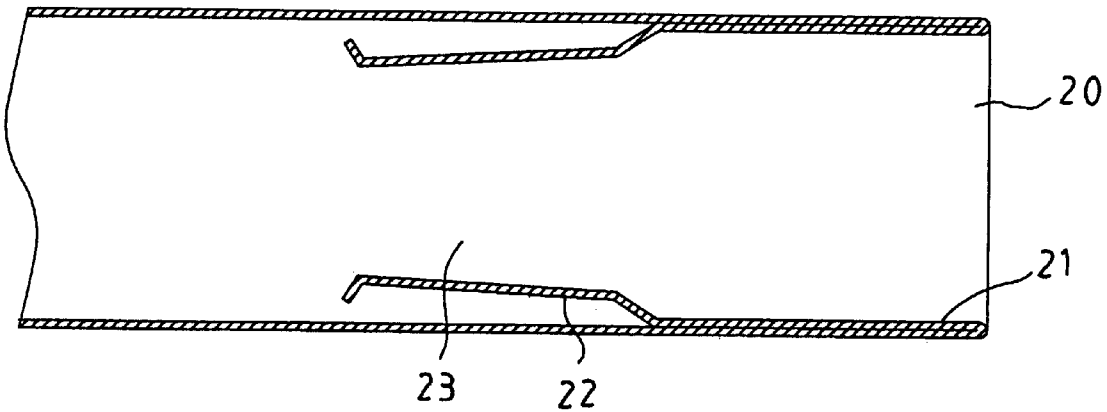
FIG. 4 PRIOR ART
FIG. 4 shows a second prior art cable connector.
Figure 6:
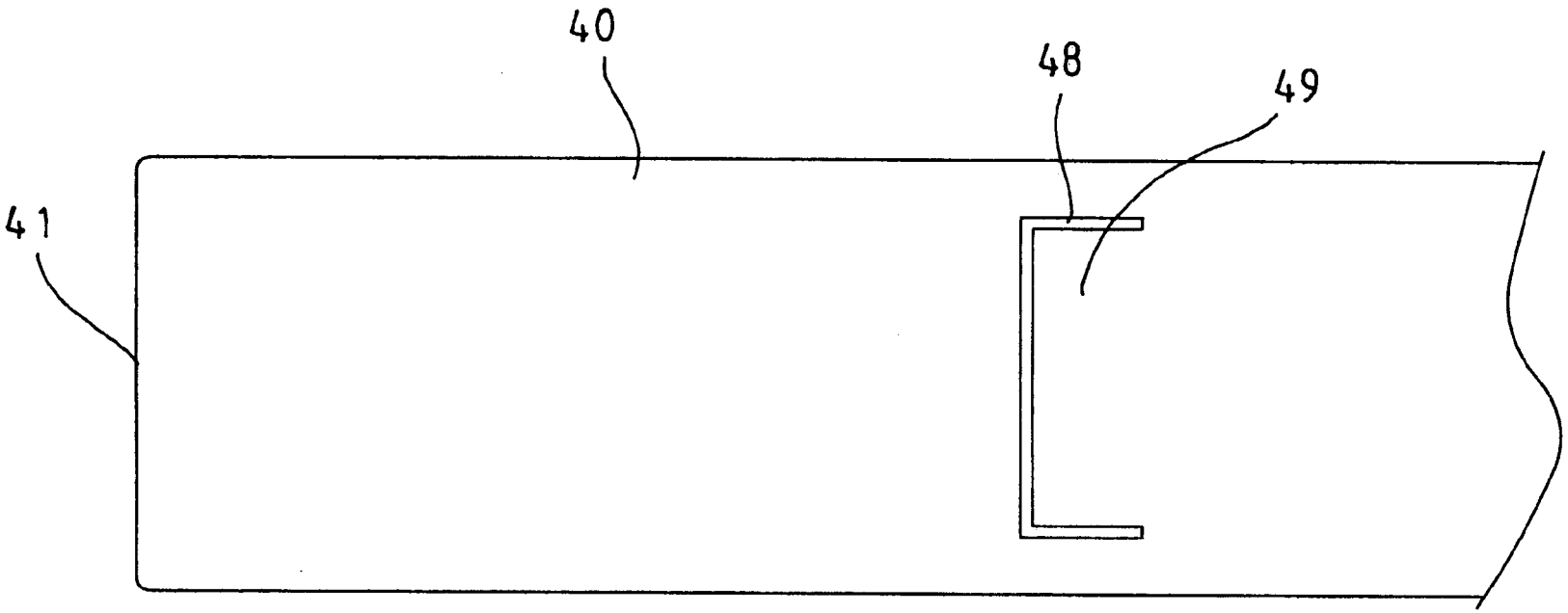
FIG. 6 shows a top plan view of the present invention.
Figure 7:
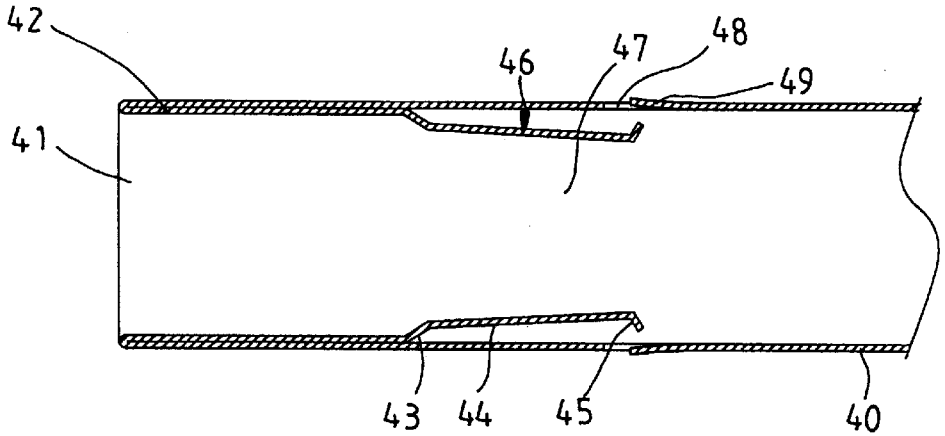
FIG. 7 shows a sectional schematic view of the present invention.
Figure 8:
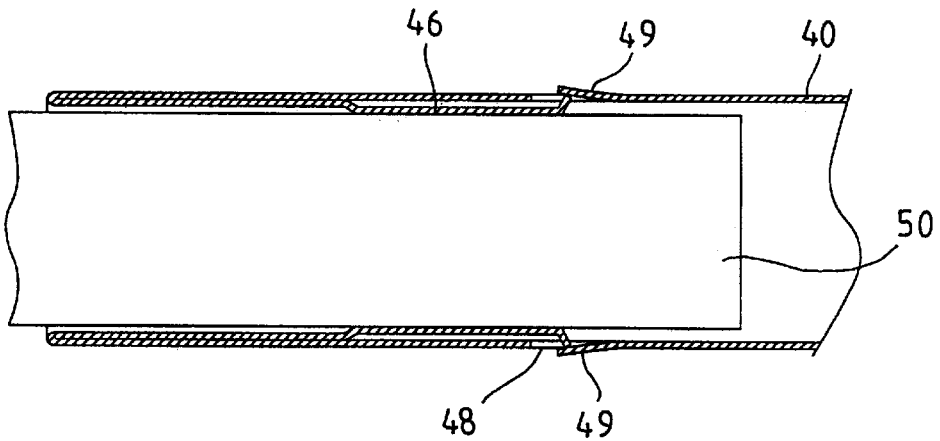
FIG. 8 is similar to FIG. 7 to show the present invention in action.

As shown in FIGS. 6–8, a cable connector of the present invention is enclosed in a plastic connector and is formed of a hollow conductive main body 40 of a cylindrical construction. The main body is made of metal, such as copper, and is provided with an open end 41 for insertion of a cable end. The open end is provided with two extension arms 42, with each integrally extending from the main body such that it is folded in reverse into the main body for a predetermined length. The folded segment is provided with a protruded section 43 extending toward the axial center of the main body and having in the rear section thereof a flat plate portion 44 which is in turn provided in the rear section with a folding back portion 45. The protruded section 43, the flat plate portion 44, and the folding back portion 45 form a projected section 46, thereby enabling the two protruded sections of the extension arms 42 to form therebetween a clamping area 47. The main body is further provided in the wall with two inverted U-shaped slits 48 corresponding in location to the ends of the extension arms. The main body is further provided with two pliable movable plate portions 49, with each being located in the area that is enclosed by the slit shape.

As shown in FIG. 7, prior to insertion of a cable end, the two projected sections 46 are neither deformed nor extruded. The two movable plate portions 49 are not jutted out of the outer diameter of the main body 40.

When a cable 50 is inserted into the clamping area 47 via the open end 41, as shown in FIG. 8, the two projected sections are extruded and deformed by the cable. As a result, the folding back portions 45 of the projected sections 46 urge outwardly the movable plate portions 49, which are then curved outwardly. In light of the expansion space, the deformed projected sections hold the inherent elasticity and holding force.

When the two movable plate portions 49 are urged to expand outwardly, the movable plate portions retain their recovery force so as to urge the folding back portion 45 of the projected sections 46. As a result, the projected sections are provided with a greater holding force in relation to the clamping area 47. The two projected sections hold firmly the cable.

The present invention has advantages. In the first place, the projected sections and the movable plate portions have a recovery force enabling them to recover inwardly, thereby enhancing the clamping force of the projected sections in relation to the clamping area. The cable is thus firmly held by the projected sections. In addition, the outward expansion angle of the movable plates is not great. For this reason, allowable space of the plastic connector is limited to enable the main body to be lodged snugly in the plastic connector.

What is claimed is:

1. A cable connector comprising a hollow conductive main body of a cylindrical construction, said main body being made of a metal conductive to electricity and provided with an open end via which a cable end is inserted, said open end provided with two extension arms, with each extending from said main body such that said extension arm is folded in reverse into said main body, said folded segment being provided with a protruded section extending toward the axial center of said main body and having in a rear section thereof a flat plate portion which is in turn provided with a folding back portion, said protruded section, said flat plate portion and said folding back portion forming together a projected section, thereby enabling said protruded sections of said extension arms to form therebetween a clamping area, said main body further provided in a wall with two slits corresponding in location to ends of said extension arms, said main body further provided with two pliable movable plate portions, with each being located in an area that is enclosed by the shape of said slit.

2. The cable connector as defined in claim 1, wherein said extension arms are made integrally with said main body.

3. The cable connector as defined in claim 1, wherein said projected section comprises a protruded section, said protruded section being provided in a rear segment with a flat plate portion, said flat plate portion provided in a rear segment with a folding back portion.

4. The cable connector as defined in claim 1, wherein said slit is of an inverted U-shaped construction.

* * * * *